US011699841B2

(12) United States Patent
Hsu et al.

(10) Patent No.: US 11,699,841 B2
(45) Date of Patent: Jul. 11, 2023

(54) ANTENNA STRUCTURE AND ELECTRONIC DEVICE USING SAME

(71) Applicant: Chiun Mai Communication Systems, Inc., New Taipei (TW)

(72) Inventors: Cho-Kang Hsu, New Taipei (TW); Min-Hui Ho, New Taipei (TW)

(73) Assignee: Chiun Mai Communication Systems, Inc., New Taipei (TW)

( * ) Notice: Subject to any disclaimer, the term of this patent is extended or adjusted under 35 U.S.C. 154(b) by 0 days.

(21) Appl. No.: 17/355,564

(22) Filed: Jun. 23, 2021

(65) Prior Publication Data

US 2022/0037764 A1 Feb. 3, 2022

(30) Foreign Application Priority Data

Jul. 30, 2020 (CN) ..... 202010754642.6

(51) Int. Cl.

| | |
|---|---|
| ***H01Q 1/24*** | (2006.01) |
| ***H01Q 1/36*** | (2006.01) |
| ***H01Q 1/50*** | (2006.01) |
| ***H01Q 21/30*** | (2006.01) |
| ***H01Q 9/04*** | (2006.01) |

(52) U.S. Cl.

CPC ..... *H01Q 1/243* (2013.01); *H01Q 1/36* (2013.01); *H01Q 1/50* (2013.01); *H01Q 9/0421* (2013.01); *H01Q 21/30* (2013.01)

(58) Field of Classification Search

CPC ..... H01Q 1/243; H01Q 1/36; H01Q 1/50; H01Q 9/0421; H01Q 21/30; H01Q 5/328; H01Q 7/00; H01Q 9/42; H01Q 21/28; H01Q 1/44; H01Q 1/22; H01Q 1/48; H01Q 5/28; H01Q 5/35; H01Q 5/50

See application file for complete search history.

(56) References Cited

U.S. PATENT DOCUMENTS

| | | | | |
|---|---|---|---|---|
| 10,804,595 | B2 * | 10/2020 | Chang | H01Q 1/243 |
| 11,024,947 | B2 * | 6/2021 | Jung | H01Q 1/243 |
| 2017/0048363 | A1 * | 2/2017 | Lee | H01Q 1/243 |

FOREIGN PATENT DOCUMENTS

| | | | |
|---|---|---|---|
| CN | 107039766 | A | 8/2017 |

* cited by examiner

*Primary Examiner* — Hai V Tran
*Assistant Examiner* — Michael M Bouizza
(74) *Attorney, Agent, or Firm* — ScienBiziP, P.C.

(57) ABSTRACT

An antenna structure with multiple frequency and MIMO capabilities applied to an electronic device includes back board, side frame, first feed point, second feed point, and first ground point. The side frame defines at least a first gap and a second gap. The first and second gaps create first and second radiation portions from the side frame. The first feed point from a source feeds current and signal to the first radiation portion. The second feed point from a source feeds current and signal to the second radiation portion. The first ground point is positioned between the first and second feed points. When the first feed point and the second feed point supply current, the first radiation portion and the second radiation generate at least one common radiation frequency band together with others.

20 Claims, 13 Drawing Sheets

ANTENNA STRUCTURE AND ELECTRONIC DEVICE USING SAME

FIELD

The subject matter herein generally relates to wireless communications, to an antenna structure and an electronic device using the antenna structure.

BACKGROUND

Antennas are for receiving and transmitting wireless signals at different frequencies. However, the antenna structure is complicated and occupies a large space in an electronic device, which makes miniaturization of the electronic device problematic.

Therefore, there is room for improvement within the art.

BRIEF DESCRIPTION OF THE DRAWINGS

Implementations of the present disclosure will now be described, by way of example only, with reference to the attached figures.

DETAILED DESCRIPTION

Figure 1:
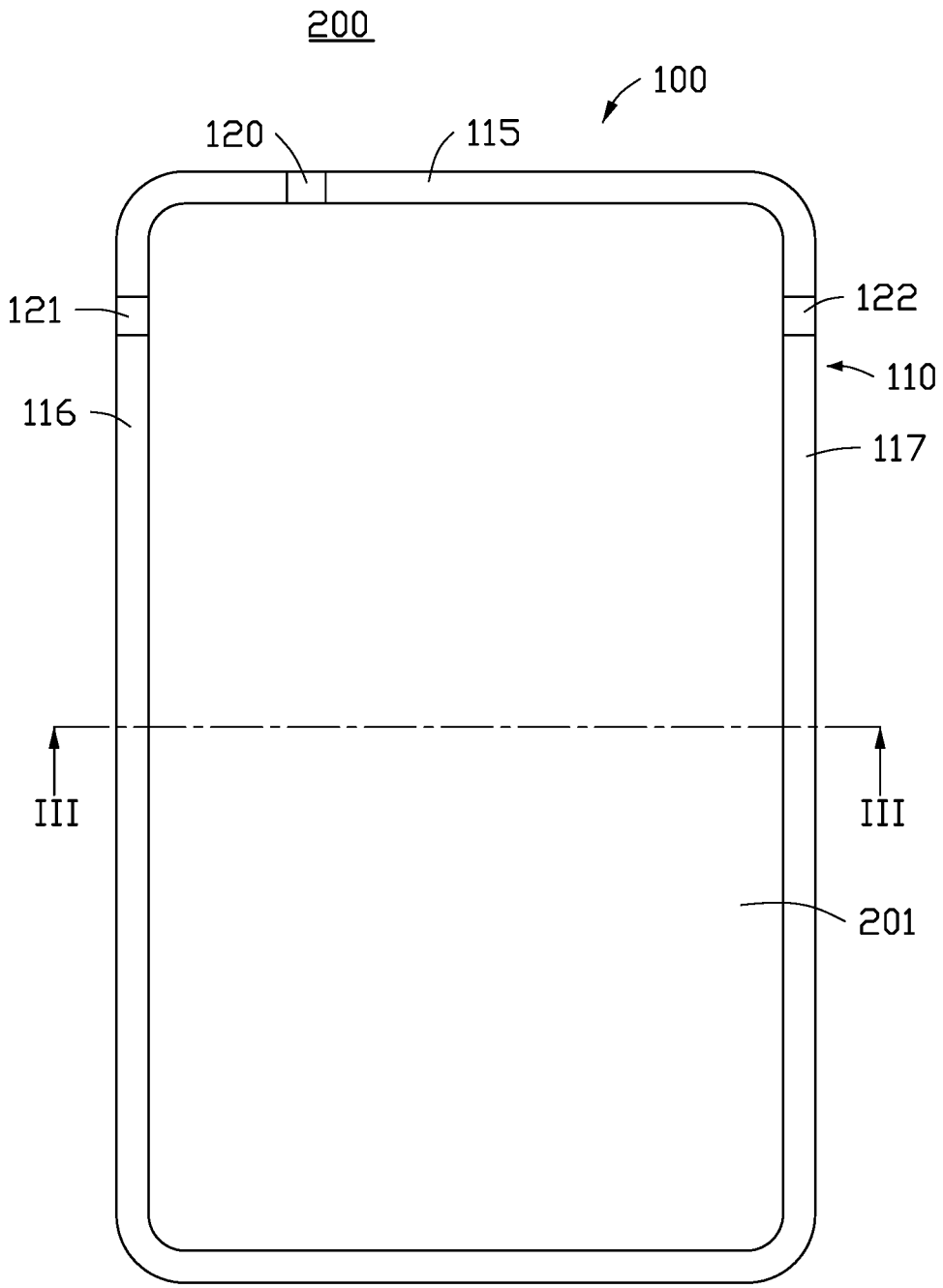
FIG. 1 is a schematic diagram of a first embodiment of an antenna structure, applied in an electronic device.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts have been exaggerated to better show details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, "substantially cylindrical" means that the object resembles a cylinder, but can have one or more deviations from a true cylinder. The term "comprising," when utilized, means "including, but not necessarily limited to"; it specifically indicates open-ended inclusion or membership in the so-described combination, group, series, and the like.

The present disclosure is described in relation to an antenna structure and an electronic device using same.

Figure 2:
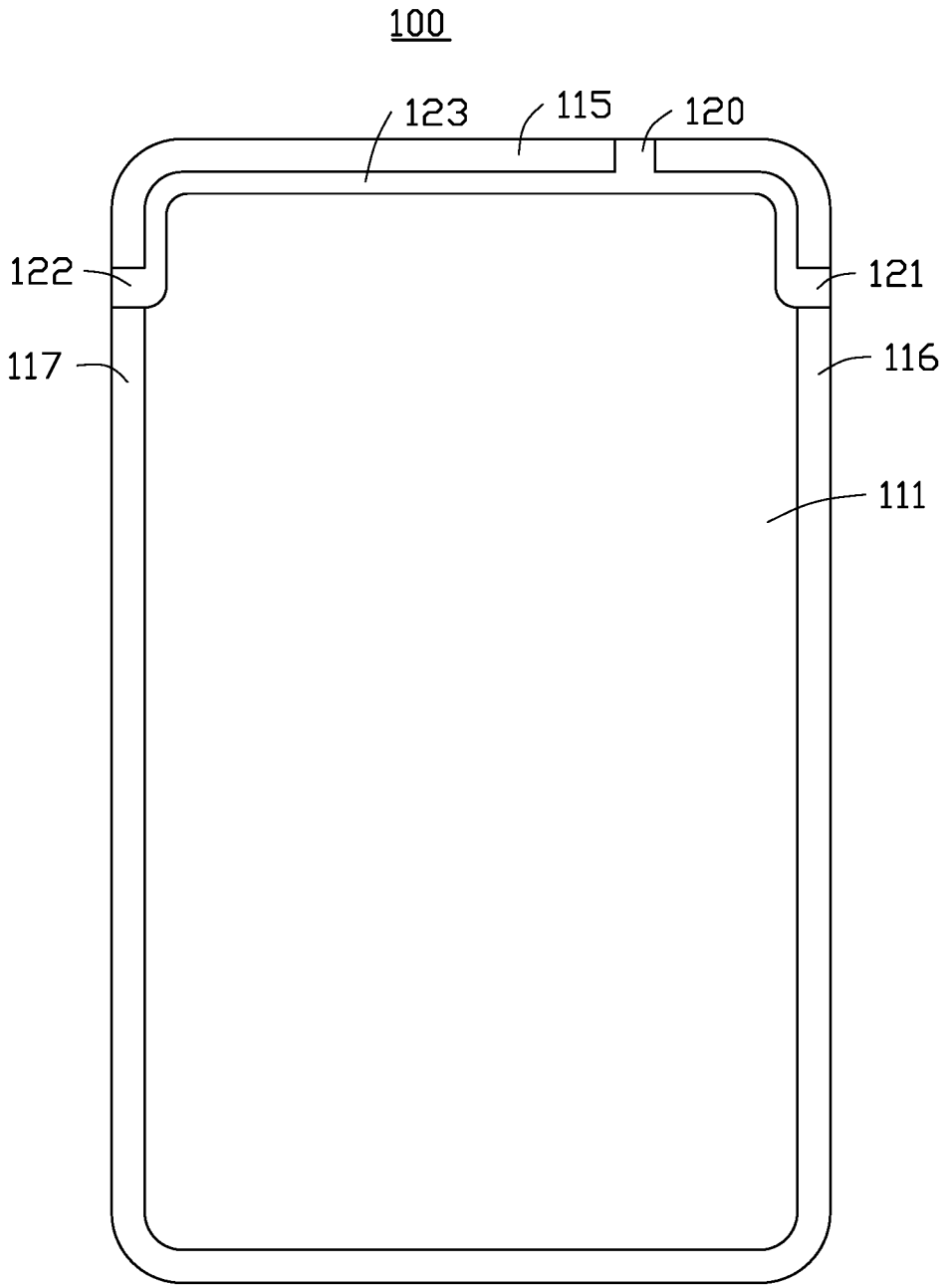
FIG. 2 is similar to FIG. 1, but the electronic device being shown from another angle.

FIG. 1 and FIG. 2 illustrate a first embodiment of an electronic device 200 using an antenna structure 100. The electronic device 200 can be, for example, a mobile phone or a personal digital assistant. The antenna structure 100 can transmit and receive radio waves, to exchange wireless signals.

In this embodiment, the electronic device 200 may use one or more of the following communication technologies: BLUETOOTH communication technology, global positioning system (GPS) communication technology, WI-FI communication Technology, global system for mobile communications (GSM) communication technology, wideband code division multiple access (WCDMA) communication technology, long term evolution (LTE) communication technology, 5G communication technology, SUB-6G communication technology, and other future communication technologies.

Figure 3:
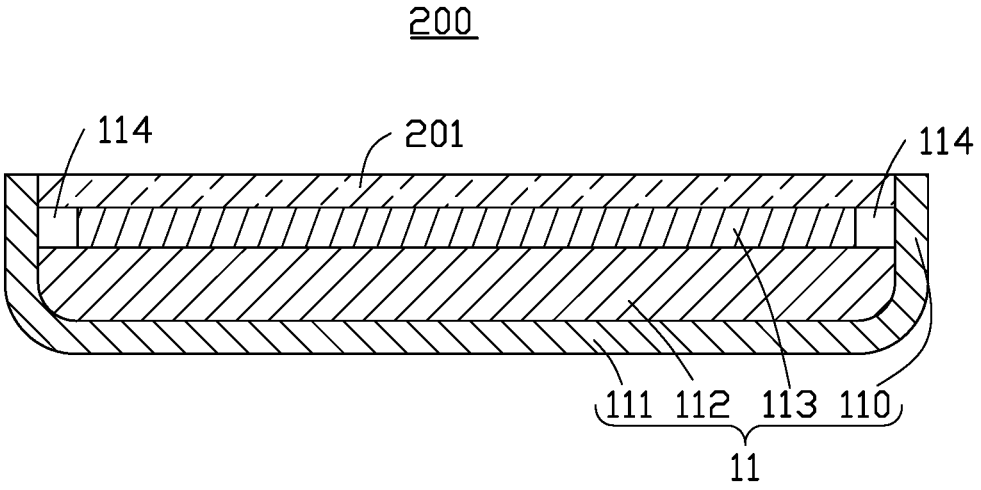
FIG. 3 is a cross-sectional view taken along line of FIG. 1.

As illustrated in FIG. 3, the electronic device 200 includes a housing 11 and a display unit 201. The housing 11 at least includes a side frame 110, a back board 111, a system ground plane 112, and a middle frame 113.

The side frame 110 is substantially a rectangular frame as a structure. The side frame 110 is made of metal or other conductive materials. The back board 111 is positioned at a periphery of the side frame 110. The back board 111 is made of metal or other conductive materials. In other embodiments, the back board 111 can also be made of insulating materials, such as glass, plastic, ceramics, and other materials.

In this embodiment, an opening (not shown) is defined on a side of the side frame 110 away the back board 111, for receiving the display unit 201 of the electronic device 200. The display unit 201 has a display plane, and the display plane is exposed through the opening. The display unit 201 can be combined with touch sensors to form a touch screen. The touch sensors can also be called a touch panel or a touch-sensitive panel.

In this embodiment, the display unit 201 has a high screen-to-body ratio. That is, an area of the display plane of the display unit 201 is greater than 70% of a frontal area of the electronic device 200, and even a full front screen (approximately 100%) can be achieved. In this embodiment, the full screen refers to a slot other than a slot 118 defined in the antenna structure 100, so the left, the right, and the lower sides of the display unit 201 can be connected to the side frame 110 seamlessly.

In this embodiment, the system ground plane 112 is made of metal or other conductive materials. The system ground plane 112 is connected to the side frame 110 for grounding the antenna structure 100.

The middle frame 113 is substantially a rectangular sheet. The middle frame 113 is made of metal or other conductive materials. A shape and size of the middle frame 113 are slightly less than those of the system ground plane 112. The middle frame 113 is stacked on the system ground plane 112. In this embodiment, an edge of the middle frame 113 is positioned so as to be spaced from the side frame 110, thus a headroom 114 is formed between the side frame 110 and the middle frame 113. In this embodiment, a distance between the side frame 110 and the middle frame 113 can be adjusted according to requirements. For example, the distance between the side frame 110 and the middle frame 113 at different locations may be one distance or different distances.

In this embodiment, the side frame 110, the back board 111, the system ground plane 112, and the middle frame 113, form an integral metal structure. The middle frame 113 is a metal sheet located between the display unit 201 and the system ground plane 112. The middle frame 113 is used to support the display unit 201, provide electromagnetic shielding, and improve mechanical strength of the electronic device 200.

In other embodiments, the electronic device 200 may also include one or more of the following components, such as a processor, a circuit board, a memory, a power supply component, an input/output circuit, an audio component (such as a microphone and a speaker, etc.), an imaging component (for example, a front camera and/or a rear camera), and several sensors (such as a proximity sensor, a distance sensor, an ambient light sensor, an acceleration sensor, a gyroscope, a magnetic sensor, a pressure sensor and/or a temperature sensor, etc.).

Figure 4:
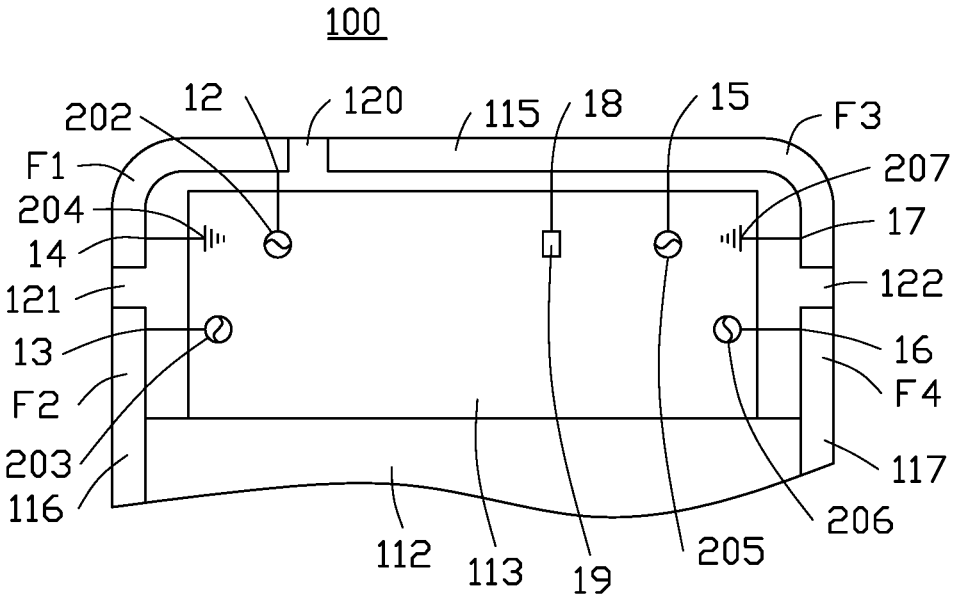
FIG. 4 is a circuit diagram of the antenna structure of the electronic device of FIG. 1.

As illustrated in FIG. 4, the antenna structure 100 at least includes a frame body, a first feed point 12, a second feed point 13, a first ground point 14, a third feed point 15, a fourth feed point 16, a second ground point 17, and a switch point 18.

The frame body is at least partially made of metal material. In this embodiment, the frame body is the side frame 110 of the electronic device 200. The side frame 110 includes at least a first portion 115, a second portion 116, and a third portion 117. The first portion 115 is at a top end of the electronic device 200. That is, the antenna structure 100 constitutes an upper antenna of the electronic device 200. The second portion 116 and the third portion 117 are positioned opposite to each other, they may be equal in length and longer than the first portion 115. The second portion 116 and the third portion 117 are the metallic side frames of the electronic device 200.

The side frame 110 defines at least one gap. In this embodiment, the side frame 110 defines three gaps, namely, a first gap 120, a second gap 121, and a third gap 122. In detail, the first gap 120 is defined in the first portion 115. The second gap 121 is defined in the second portion 116. The third gap 122 is defined in the third portion 117. The third gap 122 mirrors the second gap 121. The first gap 120 is closer to the second gap 121 than it is to the third gap 122.

In this embodiment, the first gap 120, the second gap 121, and the third gap 122 all penetrate and interrupt the side frame 110. The at least one gap cooperatively divides the side frame 110 into at least four radiation portions. In this embodiment, the first gap 120, the second gap 120, and the third gap 121 divide the side frame 110 into four radiation portions, namely a first radiation portion F1, a second radiation portion F2, a third radiation portion F3, and a fourth radiation portion F4. In this embodiment, the side frame 110 between the first gap 120 and the second gap 121 forms the first radiation portion F1. A portion of the side frame 110 below the second gap 121 (as presented in FIG. 1) forms the second radiation portion F2. The side frame 110 between the first gap 120 and the third gap 122 forms the third radiation portion F3. A portion of the side frame 110 below the third gap 122 (again referring to FIG. 1) forms the fourth radiation portion F4.

That is, the first radiation portion F1 is formed at a corner of the electronic device 200, namely, the first radiation portion F1 is (from the point of view of FIG. 4) towards the top left (that is, the first radiation portion F1 is formed by a portion of the first portion 115 and a portion of the second portion 116). Two ends of the first radiation portion F1 connect the first gap 120 and the second gap 121.

From the FIG. 4 point of view, the second radiation portion F2 is positioned at a left and lower side of the electronic device 200. That is, the second radiation portion F2 is formed by a portion of the second portion 116. One end of the second radiation portion F2 is connected to the second gap 121. The other end of the second radiation portion F2 is connected to the back board 111 and the system ground plane 112. A radiating electrical length of the first radiation portion F1 is greater than that of the second radiation portion F2.

The third radiation portion F3 (at top middle and right of FIG. 4) is formed by a portion of the first portion 115 and a portion of the third portion 117. Two ends of the third radiation portion F3 connect the first gap 120 and the third gap 122.

From the FIG. 4 point of view, the fourth radiation portion F4 is positioned at a right and lower side of the electronic device 200 and is formed by a portion of the third portion 117. One end of the fourth radiation portion F4 is connected to the third gap 122. The other end of the fourth radiation portion F4 is connected to the back board 111 and the system ground plane 112. A radiating electrical length of the third radiation portion F3 is greater than that of the first radiation portion F1.

As illustrated in FIG. 2, an edge of the back board 111 near the side frame 110 defines a slot 123. The slot 123 is substantially U-shaped. The slot 123 is defined on the side of the back board 111 close to the first portion 115, and extends in directions of the second portion 116 and the third portion 117. The slot 123 communicates with the first gap 120, the second gap 121, and the third gap 122.

In this embodiment, the first gap 120, the second gap 121, the third gap 122, and the slot 123 are all filled with an insulating material (such as plastic, rubber, glass, wood, ceramic, etc., not being limited to these).

In this embodiment, when a width of one of the first gap 120, the second gap 121, and the third gap 122 is less than 2 millimeters (mm), radiation efficiency of the antenna structure 100 is affected. Therefore, the widths of the second gap 121 and the third gap 122 are generally not less than 2 mm. In this embodiment, considering an overall aesthetic appearance of the electronic device 200 and a radiation efficiency of the antenna structure 100, the widths of the first gap 120, the second gap 121, and the third gap 122 can all be set to 2 mm.

In this embodiment, the first feed point 12 is positioned on the first radiation portion F1 and on the first portion 115. The first feed point 12 may be electrically connected to a first signal feed source 202 by means of an elastic sheet, a microstrip line, a strip line, or a coaxial cable, to feed current and signals to the first radiation portion F1.

The second feed point 13 is positioned on the second radiation portion F2 and on the second portion 116. The second feed point 13 may be electrically connected to a second signal feed source 203, to feed current and signals to the second radiation portion F2.

The first ground point 14 is positioned on the first radiation portion F1 and on the second portion 116. One end the first ground point 14 may be electrically connected to a first system ground 204 by means of an elastic sheet, a microstrip line, a strip line, or a coaxial cable, to ground the first radiation portion F1. In this embodiment, the first ground point 14 is positioned between the first feed point 12 and the second feed point 13, namely, the first feed point 12 and the second feed point 13 are positioned at two sides of the first ground point 14. In detail, the first ground point 14 and the second feed point 13 are positioned at either side of the second gap 121, and are positioned adjacent to each other.

In this embodiment, the third feed point 15 is positioned on the third radiation portion F3 and on the first portion 115. The third feed point 15 may be electrically connected to a third signal feed source 205, to feed current and signals to the third radiation portion F3.

The fourth feed point 16 is positioned on the fourth radiation portion F4 and on the third portion 117. In this embodiment, the fourth feed point 16 and the second feed point 13 are positioned symmetrically around a vertical center line of the electronic device 200. One end of the fourth feed point 16 and one end of the second feed point 13 are grounded through the system ground plane 112. The fourth feed point 16 may be electrically connected to a fourth signal feed source 206, to feed current and signals to the fourth radiation portion F4.

In this embodiment, the second ground point 17 is positioned on the third radiation portion F3 and on the third portion 117. In this embodiment, the first and second ground points 17 and 14 are positioned symmetrically around the vertical center line. The second ground point 17 is electrically connected to a second system ground 207 by means of an elastic sheet, a microstrip line, a strip line, or a coaxial cable. Alternatively, the second ground point 17 may be electrically connected to the second system ground 207 through a middle/high band conditioner (MHC/HHC) (not shown), to ground the third radiation portion F3. In one embodiment, the MHC/HHC may be an inductance, a capacitance, or a combination thereof.

In this embodiment, the second ground point 17 is positioned between the third feed point 15 and the fourth feed point 16, namely, the third feed point 15 and the fourth feed point 16 are positioned at each side of the second ground point 17. In detail, the second ground point 17 and the fourth feed point 16 are positioned at either side of the third gap 122, and are positioned adjacent to each other.

The switch point 18 is positioned on the third radiation portion F3 and on the first portion 115. In this embodiment, the switch point 18 is almost directly between the first gap 120 and the third feed point 15. In this embodiment, the switch point 18 is also electrically connected to the system ground plane 112 through a switch circuit 19, that is, it is grounded.

In this embodiment, the specific structure of the switch circuit 19 may take various forms, for example, it may include a single switch, a multiple switch, a single switch with a matching component, or a multiple switch with a matching component.

Figure 5A:
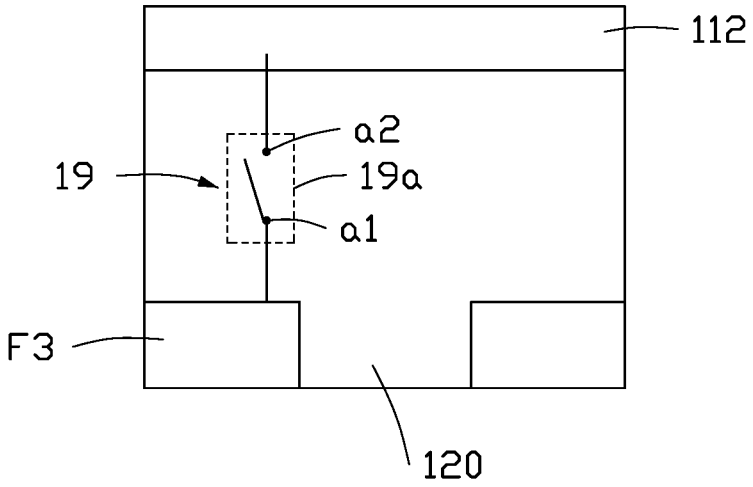
FIGS. 5A, 5B, 5C, and 5D are circuit diagrams of a switch circuit of the antenna structure of FIG. 4.

Referring to FIG. 5A, the switch circuit 19 includes a single switch 19*a*. The single switch 19*a* includes a movable contact a1 and a static contact a2. The movable contact a1 is electrically connected to the third radiation portion F3. The static contact a2 of the single switch 19*a* is electrically connected to the system ground plane 112. By turning the single switch 19*a* on or off, the third radiation portion F3 is electrically connected or disconnected from the system ground plane 112, and the third radiation portion F3 is thereby grounded or not grounded, to achieve the functions of multiple frequencies.

Figure 5B:
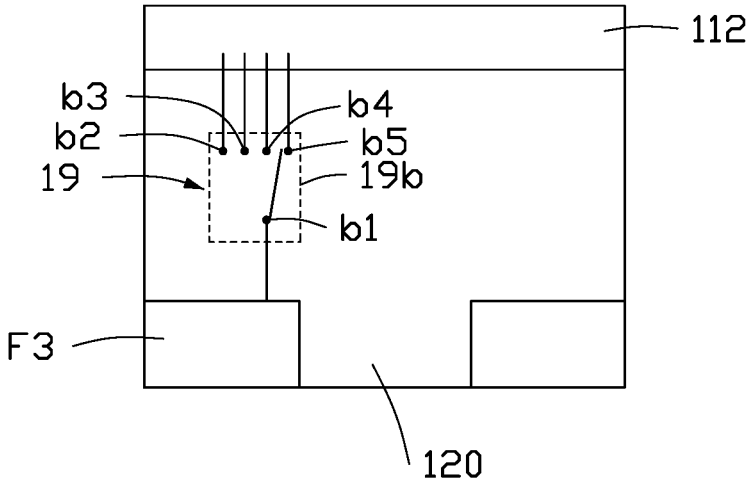

Referring to FIG. 5B, the switch circuit 19 includes a multiplexing switch 19*b*. In the embodiment, the multiplexing switch 19*b* is a four-way switch. The multiplexing switch 19*b* includes a movable contact b1, and first to fourth static contacts b2, b3, b4, and b5. The movable contact b1 is electrically connected to the third radiation portion F3. The first to fourth static contacts, b2 to b5, are each electrically connected to different points of the system ground plane 112.

By controlling the switching of the movable contact b1, the movable contact b1 can be switched to any one of the first static contact b2, the second static contact b3, the third static contact b4, and the fourth static contact b5. Thereby, the third radiation portion F3 may be electrically connected to different locations of the system ground plane 112, achieving the functions of multi-frequency operations.

Figure 5C:
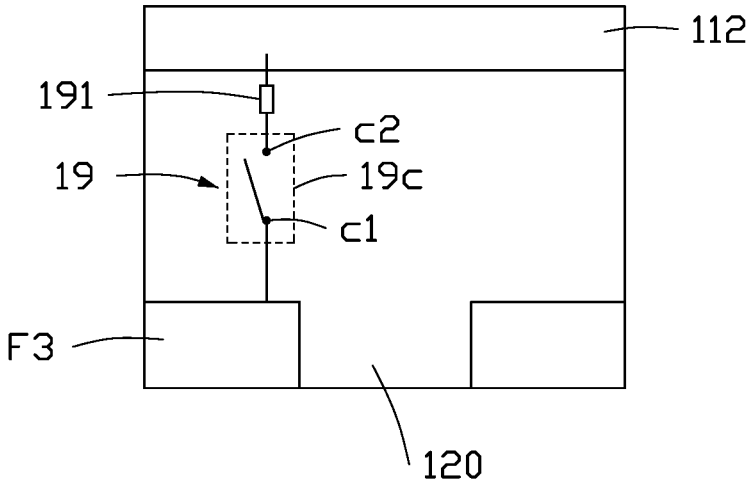

Referring to FIG. 5C, the switch circuit 19 includes a single switch 19*c* and an impedance-matching component 191. The single switch 19*c* includes a movable contact c1 and a static contact c2. The movable contact c1 is electrically connected to the third radiation portion F3. The static contact c2 is electrically connected to the system ground plane 112 through the impedance-matching component 191. The impedance-matching component 191 has a preset impedance. The impedance-matching component 191 may include an inductor, a capacitor, or a combination of an inductor and a capacitor.

Figure 5D:
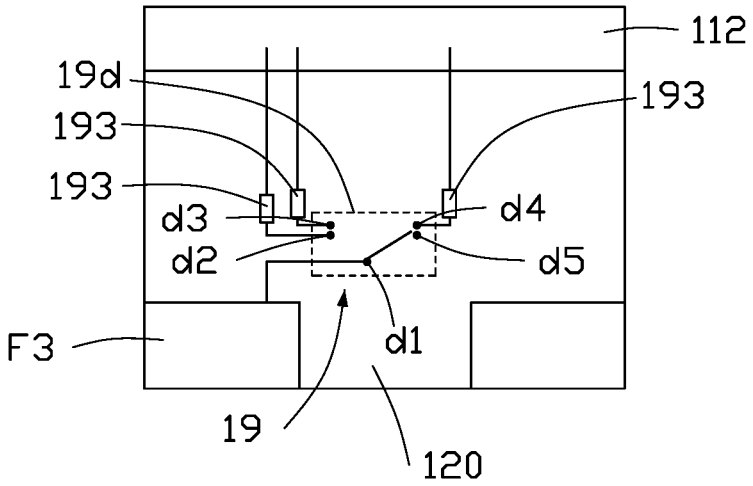

Referring to FIG. 5D, the switch circuit 19 includes a multiplexing switch 19*d* and at least one impedance-matching component 193. In this embodiment, the multiplexing switch 19*d* is a four-way switch, and the switch circuit 19 includes three impedance-matching components 193. The multiplexing switch 19*d* includes a movable contact d1, and first to fourth static contacts d2, d3, d4, and d5. The movable contact d1 is electrically connected to the third radiation portion F3. The first to third static contacts, d2 to d4, are electrically connected to the system ground plane 112 through impedance-matching components 193. The fourth static contact d5 can be left open (i.e., not connected to anything). Each of the impedance-matching components 193 has a preset impedance, and the preset impedances of the impedance-matching components 193 may be the same or different. Each of the impedance-matching components 193 may include an inductor, a capacitor, or a combination of an inductor and a capacitor. The location of each of the impedance-matching components 193 electrically connected to the system ground plane 112 may be the same or different.

By controlling the switching of the movable contact d1, the movable contact d1 can be switched to any of the first static contact d2, the second static contact d3, the third static contact d4, or the fourth static contact d5. Therefore, the third radiation portion F3 may be electrically connected to the system ground plane 112 or disconnected from the system ground plane 112 through different impedance-matching components 193, thereby achieving the functions of multi-frequency operations.

Figure 6:
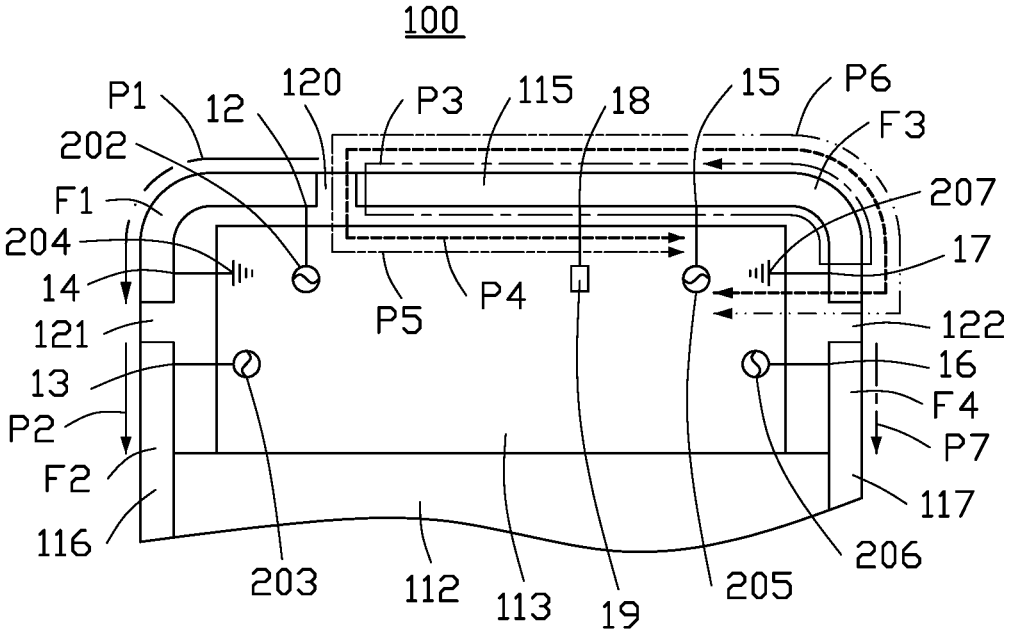
FIG. 6 is a current path distribution graph of the antenna structure of FIG. 4.

FIG. 6 illustrates a diagram of current paths of the antenna structure 100. The first radiation portion F1 is a loop antenna. When the first feed point 12 supplies a current, the current flows through the first radiation portion F1, toward the second gap 121 (path P1), to excite a first working mode and generate a radiation signal in a first radiation frequency band.

When the second feed point 13 supplies a current, the current will flow through the second radiation portion F2, toward the system ground plane 112 and the middle frame (path P2), to excite a second working mode and generate a radiation signal in a second radiation frequency band.

In this embodiment, the third radiation portion F3 is a monopole antenna. When the third feed point 15 supplies a current, the current will flow through the third radiation portion F3, toward the first gap 120. Then, the current flows to the back board 111, the system ground plane 112, and the middle frame 113, then flows to the third gap 122, and finally flows toward the third feed point 15 through the third radiation portion F3 (path P3), to excite a third working mode and generate a radiation signal in a third radiation frequency band.

When the third feed point 15 supplies a current, the current flows through the third radiation portion F3, toward the first gap 120 and the third gap 122 (path P4), to excite a fourth working mode and generate a radiation signal in a fourth radiation frequency band.

When the third feed point 15 supplies a current, the current flows through the third radiation portion F3, toward the first gap 120 (path P5), to excite a fifth working mode and generate a radiation signal in a fifth radiation frequency band.

When the third feed point 15 supplies a current, the current flows through the third radiation portion F3, toward the third gap 122 (path P6), to excite a sixth working mode and generate a radiation signal in a sixth radiation frequency band.

When the fourth feed point 16 supplies a current, the current flows through the fourth radiation portion F4, toward the system ground plane 112 and middle frame 113 (path P7), to excite a seventh working mode and generate a radiation signal in a seventh radiation frequency band.

In this embodiment, the first working mode includes a global positioning system (GPS) mode, a WIFI 2.4 GHz mode, a WIFI 5 GHz mode, and a Licensed-Assisted Access (LAA) mode. The frequencies of the first radiation frequency band include 1575 MHz, 2400-2484 MHz, 5150-5850 MHz, and 5150-5925 MHz. The second working mode includes a WIFI 2.4 GHz mode, a WIFI 5 GHz mode, and LAA mode. The frequencies of the second radiation frequency band include 2400-2484 MHz, 5150-5850 MHz, and 5150-5925 MHz. The third working mode includes a Long Term Evolution Advanced (LTE-A) low frequency mode. The frequencies of the third radiation frequency band include 700-960 MHz.

The fourth working mode includes ultra-middle frequency (UMB), an LTE-A middle frequency mode, and an LTE-A high-frequency mode. The frequencies of the fourth radiation frequency band include 1427-1518 MHz, 1710-2170 MHz, and 2300-2690 MHz. The fifth working mode includes ultra-high frequency (UHB) mode and 5G N78 mode. The frequencies of the fifth working mode include 3300-3800 MHz. The sixth working mode includes 5G N79 mode. The frequencies of the sixth working mode include 4400-5000 MHz. The seventh working mode includes LTE-A middle-frequency, high-frequency modes, UHB mode, 5G N78 mode, and 5G N79 mode. The frequencies of the seventh working mode include 1710-2170 MHz, 2300-2690 MHz, 3300-3800 MHz, and 4400-5000 MHz.

In this embodiment, the first radiation part F1 constitutes a GPS, WIFI 2.4G/5G, and LAA antenna. The second radiation portion F2 constitutes a WIFI 2.4G/5G, and LAA antenna. The third radiation portion F3 constitutes an LTE-A low, middle, high frequency, ultra-middle frequency, ultra-high frequency, and 5G N78/N79 antenna. The fourth radiation portion F4 constitutes an LTE-A middle-frequency, high-frequency, ultra-middle frequency, ultra-high frequency, and 5G N78/N79 antenna. In other words, the first radiation portion F1 and the second radiation portion F2 have at least one common radiation frequency band, and the radiation frequency bands of the two radiation portions overlap. For example, excepting the 1575 MHz frequency band, the first radiation portion F1 and the second radiation portion F2 can both generate radiation frequency bands of 2400-2484 MHz and 5150-5925 MHz. Similarly, the third radiation portion F3 and the fourth radiation portion F4 have at least one common radiation frequency band, and the radiation frequency bands of the third radiation portion F3 and the fourth radiation portion F4 overlap. For example, excepting the 700-960 MHz and 1427-1518 MHz frequency bands, the third radiation portion F3 and the fourth radiation portion F4 can both generate radiation frequency bands of 1710-2170 MHz, 2300-2690 MHz, 3300-3800 MHz, and 4400-5000 MHz. In this way, the electronic device 200 can implement a Multiple Input Multiple Output (MIMO) function. For example, when the electronic device 200 is provided with a lower antenna at the bottommost part, the electronic device 200 can be made to support 4*4 MIMO.

Figure 7:
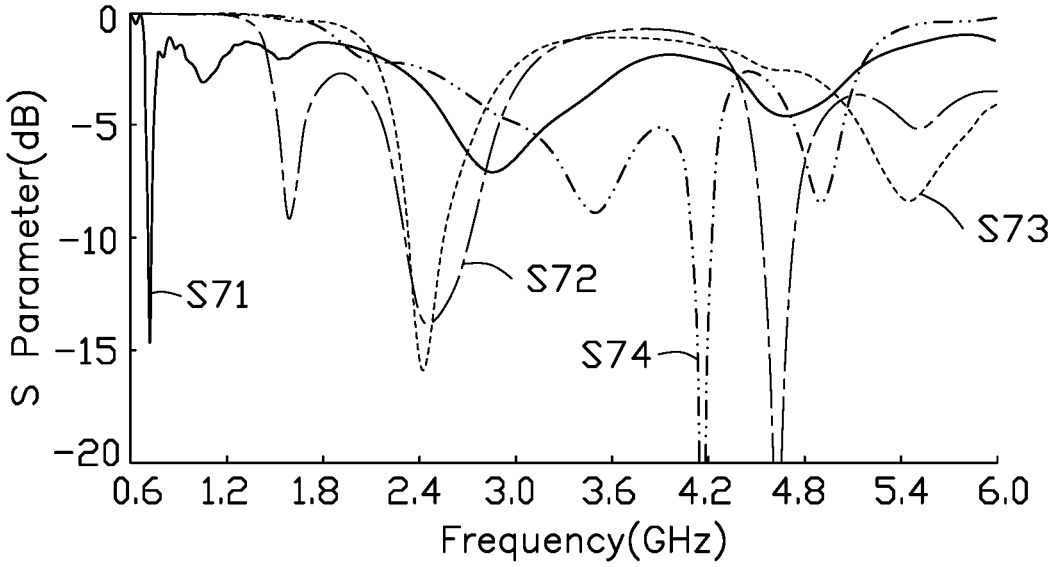
FIG. 7 is a scattering parameter graph of the antenna structure of FIG. 4.

FIG. 7 is a graph of scattering parameters (S parameters) of the antenna structure 100. A curve S71 is an S11 value of the third radiation portion F3 when the antenna structure 100 works. A curve S72 is an S11 value of the first radiation portion F1 when the antenna structure 100 works. A curve S73 is an S11 value of the second radiation portion F2 when the antenna structure 100 works. A curve S74 is an S11 value of the fourth radiation portion F4 when the antenna structure 100 works.

Figure 8:
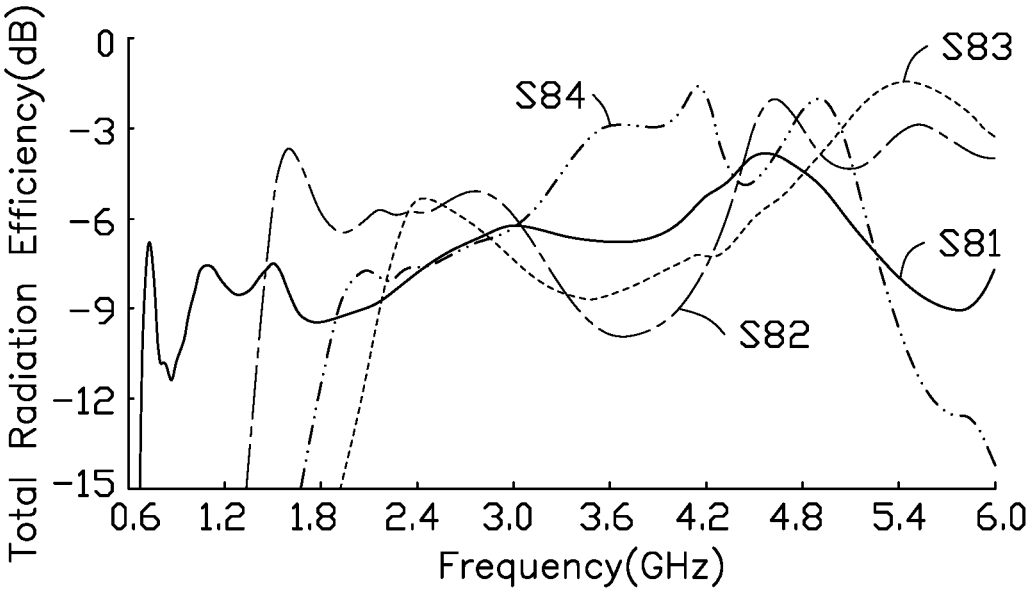
FIG. 8 is a total radiation efficiency graph of the antenna structure of FIG. 4.

FIG. 8 is a graph of total radiation efficiency of the antenna structure 100. A curve S81 is a total radiation efficiency of the third radiation portion F3 when the antenna structure 100 works. A curve S82 is a total radiation efficiency of the first radiation portion F1 when the antenna structure 100 works. A curve S83 is a total radiation efficiency of the second radiation portion F2 when the antenna structure 100 works. A curve S84 is a total radiation efficiency of the fourth radiation portion F4 when the antenna structure 100 works.

FIG. 7 to FIG. 8 show that the antenna structure 100 can form at least four independent radiation elements by providing multiple gaps, such as the first gap 120, the second gap 121, and the third gap 122. Among them, the first radiation portion F1 can excite GPS, Wi-Fi 2.4G, Wi-Fi 5G and LAA modes (covering frequency ranges of 1575 Hz, 2400-2484 MHz and 5150-5925 MHz). The second radiation portion F2 can excite Wi-Fi 2.4G, Wi-Fi 5G and LAA modes (covering frequency ranges of 2400-2484 MHz and 5150-5925 MHz). The third radiation portion F3 can excite low, middle, high, frequencies, ultra-middle frequency, ultra-high frequency, 5G N78, and N79 modes. The fourth radiation portion F4 can excite middle frequency, high frequency, ultra-high frequency, 5G N78 and N79 modes (frequency covers 1710-2170 MHz, 2300-2690 MHz, 3300-

3800 MHz and 4400-5000 MHz), thereby effectively increasing the bandwidth and antenna efficiency, and also making MIMO characteristics available. Furthermore, by providing the switch circuit 19, the low frequency modes of the antenna structure 100 can be effectively switched, thereby effectively increasing the low frequency bandwidth and giving better antenna efficiency. The low frequency of the antenna structure 100 covers B17/B13/B20/B5/B8 frequency band. Among them, the frequency range of the B17 frequency band is 704-746 MHz, the frequency range of the B13 frequency band is 746-787 MHz, the frequency range of the B20 frequency band is 791-862 MHz, and the frequency range of the B8 frequency band is 880-960 MHz.

The antenna structure 100 can cover low frequency, middle frequency, high frequency, ultra-middle frequency, ultra-high frequency, 5G N78/N79, GPS, Wi-Fi 2.4G, Wi-Fi 5G, LAA, and other use frequency bands. The antenna structure 100 can greatly increase its bandwidth and antenna efficiency, and can also cover applications in global frequency bands and support LTE-A carrier aggregation (CA) requirements. The antenna structure 100 can cover GSM850/900/WCDMA B5/B8/B13/B17/B20 at low frequencies, GSM 1800/1900/WCDMA 2100 (1710-2170 MHz) at middle frequencies, and LTE B7/B40/B41 at high frequencies (2300-2690 MHz), ultra-middle frequency covers 1427-1518 MHz, ultra-high frequency covers 3400-3800 MHz, and a new spectrum of 5G covers N78 (3300-3800 MHz)/N79 (4400-5000 MHz).

In addition, the antenna structure 100 may also cover GPS, Wi-Fi 2.4G, Wi-Fi 5G, and LAA (5150-5925 MHz). The available frequency bands of the antenna structure 100 can be applied to the operation of GSM Qual-band, UMTS Band I/II/V/VIII frequency bands, and LTE 850/900/1800/1900/2100/2300/2500 frequency bands, as commonly used worldwide.

Figure 9:
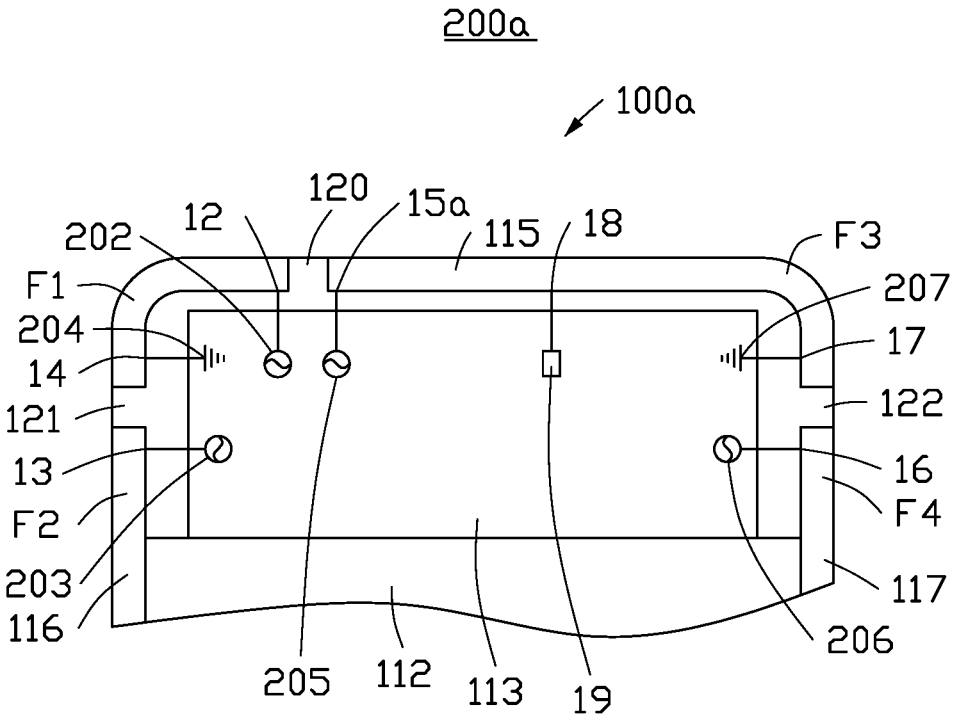
FIG. 9 is a schematic diagram of a second embodiment of an antenna structure.

FIG. 9 illustrates a second embodiment of an electronic device 200*a* using an antenna structure 100*a*. The electronic device 200*a* can be, for example, a mobile phone or a personal digital assistant. The antenna structure 100*a* can transmit and receive radio waves, to exchange wireless signals.

The antenna structure 100*a* at least includes the side frame 110, the first feed point 12, the second feed point 13, the first ground point 14, the third feed point 15*a*, the fourth feed point 16, the second ground point 17, and the switch point 18. The side frame 110 defines the first gap 120, the second gap 121, and the third gap 122, to create the first radiation portion F1, the second radiation portion F2, the third radiation portion F3, and the fourth radiation portion F4.

A difference between the antenna structure 100*a* and the antenna structure 100 is that the location of the third feed point 15*a* on the third radiation portion F3 is different from the location of the third feed point 15 on the third radiation portion F3. Specifically, in this embodiment, the third feed point 15*a* is disposed on the third radiation portion F3 and is located between the first gap 120 and the switch point 18. That is, the third feed point 15*a* is closer than the switch point 18 to the first gap 120.

In this embodiment, a working principle and specific working frequency bands of the first radiation portion F1, the second radiation portion F2, the fourth radiation portion F4 of the antenna structure 100*a* are the same as those of the antenna structure 100, and will not be repeated here. The working principle and specific working frequency band of the third radiation portion F3 of the antenna structure 100*a* are however different.

Figure 10:
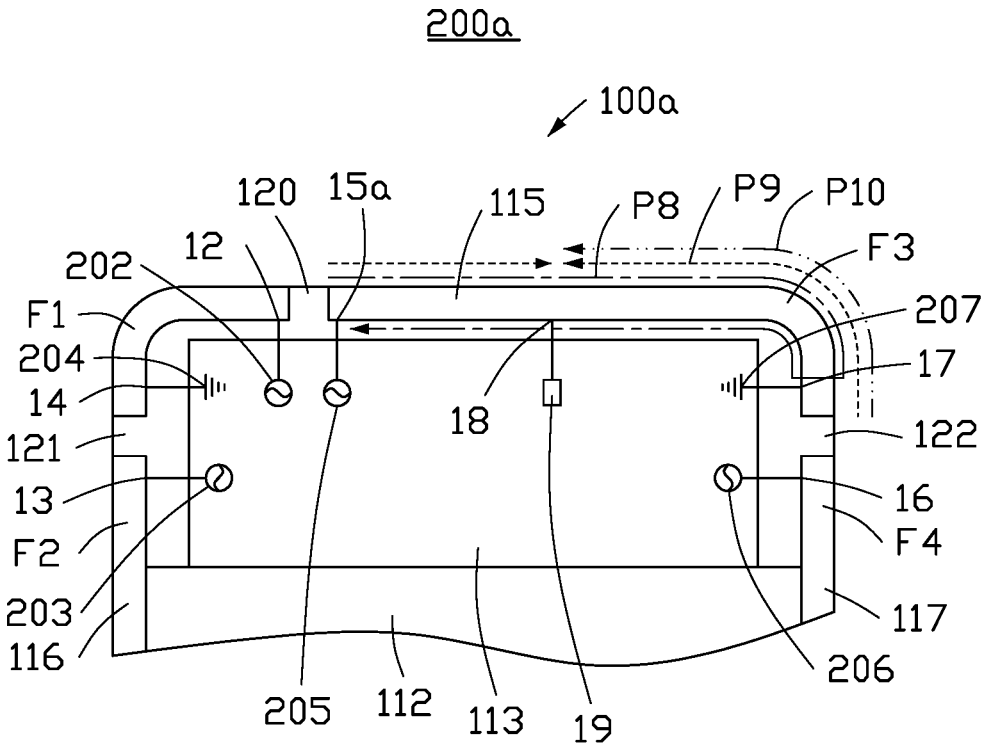
FIG. 10 is a current path distribution graph of the antenna structure of FIG. 9.

As illustrated in FIG. 10, in the 100*a* embodiment, when the third feed point 15*a* supplies a current, the current will flow through the third radiation portion F3 and flow to the third gap 122, then flow into the back board 111, the system ground plane 112, and the middle frame 113, and then flow to the third feed point 15*a* (path P8), to excite the third working mode and generate a radiation signal in the third radiation frequency band.

When the third feed point 15*a* supplies a current, the current will flow through the third radiation portion F3, and flow to the switch point 18 and the switch circuit 19, and then pass through the third radiation portion F3 through a coupling current of the fourth feed point 16, and flows to the switch point 18 and the switch circuit 19 (path P9), to excite the fourth working mode and generate a radiation signal in the fourth radiation frequency band.

In this embodiment, the coupling current from the fourth feed point 16 further flows through the third radiation portion F3, and flows towards the switch point 18 and the switch circuit 19 (path P10), to excite the fifth and sixth working modes and generate a radiation signal in the fifth and sixth radiation frequency bands.

Figure 11:
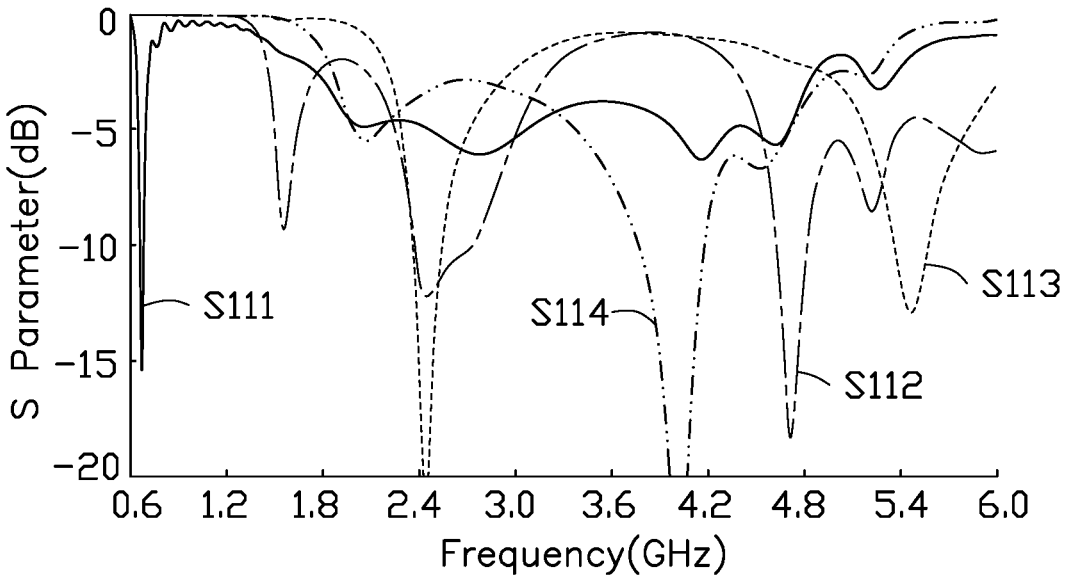
FIG. 11 is a scattering parameter graph of the antenna structure of FIG. 9.

FIG. 11 is a graph of scattering parameters (S parameters) of the antenna structure 100*a*. A curve S111 is an S11 value of the third radiation portion F3 when the antenna structure 100*a* works. A curve S112 is an S11 value of the first radiation portion F1 when the antenna structure 100*a* works. A curve S113 is an S11 value of the second radiation portion F2 when the antenna structure 100*a* works. A curve S114 is an S11 value of the fourth radiation portion F4 when the antenna structure 100*a* works.

Figure 12:
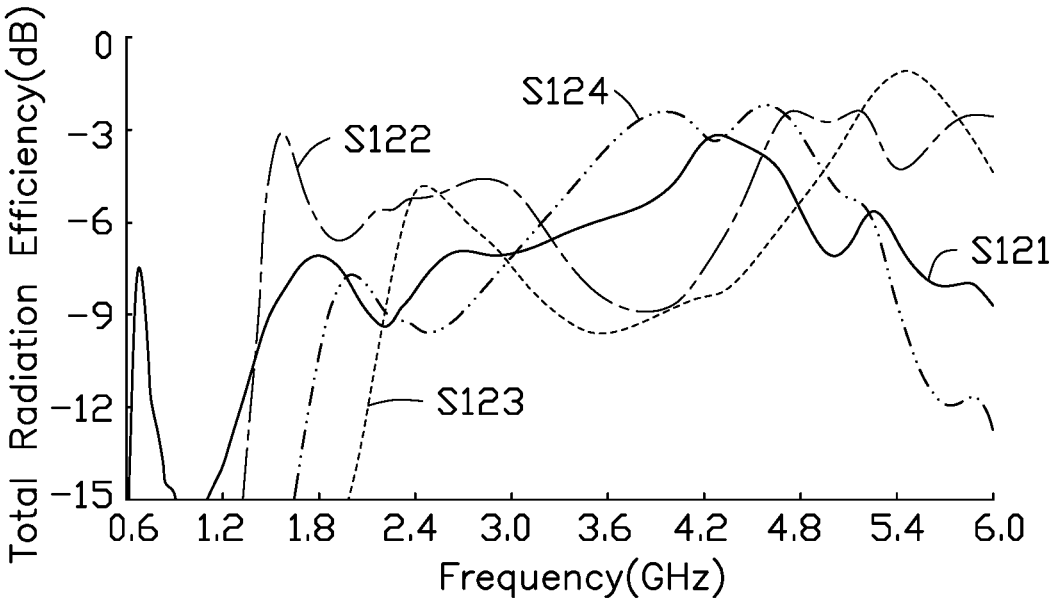
FIG. 12 is a total radiation efficiency graph of the antenna structure of FIG. 9.

FIG. 12 is a graph of total radiation efficiency of the antenna structure 100*a*. A curve S121 is a total radiation efficiency of the third radiation portion F3 when the antenna structure 100*a* works. A curve S122 is a total radiation efficiency of the first radiation portion F1 when the antenna structure 100*a* works. A curve S123 is a total radiation efficiency of the second radiation portion F2 when the antenna structure 100*a* works. A curve S124 is a total radiation efficiency of the fourth radiation portion F4 when the antenna structure 100*a* works.

Similar to the antenna structure 100 of the first embodiment, the antenna structure 100*a* forms at least four independent radiation portions by providing multiple gaps, such as the first gap 120, the second gap 121, and the third gap 122. Among them, the first radiation portion F1 can excite GPS, Wi-Fi 2.4G, Wi-Fi 5G and LAA modes (covering frequency ranges of 1575 Hz, 2400-2484 MHz and 5150-5925 MHz). The second radiation portion F2 can excite Wi-Fi 2.4G, Wi-Fi 5G and LAA modes (covering frequency ranges of 2400-2484 MHz and 5150-5925 MHz).

The third radiation portion F3 can excite low frequency, middle frequency, high frequency, ultra-middle frequency, ultra-high frequency, 5G N78 and N79 modes. The fourth radiation portion F4 can excite middle frequency, high frequency, ultra high frequency, 5G N78 and N79 modes (frequency covers 1710-2170 MHz, 2300-2690 MHz, 3300-3800 MHz, and 4400-5000 MHz), thereby effectively increasing the bandwidth, antenna efficiency, and also giving MIMO characteristics.

Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An antenna structure comprising:

a back board defining a slot;

a side frame made of metal material and positioned at a periphery of the back board, wherein the side frame defines at least a first gap and a second gap, the slot is defined at an edge of the back board near the side frame and communicates with the first gap and the second gap; wherein the first gap and the second gap divide a first radiation portion and a second radiation portion from the side frame;

a first feed point positioned on the first radiation portion and being electrically connected to a first feed source for feeding current and signal to the first radiation portion;

a second feed point positioned on the second radiation portion and being electrically connected to a second feed source for feeding current and signal to the second radiation portion; and a first ground point positioned on the first radiation portion and between the first feed point and the second feed point;

wherein when the first feed point and the second feed point supplies current, the first radiation portion and the second radiation generate at least one same radiation frequency band, when current is fed from the first feed point, the first radiation portion excites a GPS mode, a WIFI 2.4 GHz Mode, a WIFI 5 GHz mode and a licensed spectrum auxiliary access (LAA) mode, when current is fed from the second feed point, the second radiation portion excites the WIFI 2.4 GHz mode, the WIFI 5 GHz mode and the LAA mode; and wherein the side frame between the first gap and the second gap forms the first radiation portion, a portion of the side frame which extends from the second gap along a direction away from the first gap and the first radiation portion forms the second radiation portion.

2. The antenna structure of claim 1, wherein the side frame at least comprises a first portion and a second portion, the second portion is connected to one end of the first portion, the second portion is longer than the first portion, the first gap is defined on the first portion, the second gap is defined on the second portion;

wherein the first ground point and the second feed point are defined at two sides of the second gap, the first feed point is closer to the first gap than the first ground point.

3. The antenna structure of claim 1, wherein the side frame defines a third gap, the third gap is symmetrically arranged with the second gap, and is farther away from the first gap than the second gap;

wherein the side frame between the first gap and the third gap forms a third radiation portion, the third radiation portion is longer than the first radiation portion;

wherein the antenna structure further comprises a third feed point and a second ground point, the third feed point is positioned on the third radiation portion and is electrically connected to a third feed source for feeding current and signal to the third radiation portion, the second ground point is positioned on the third radiation portion.

4. The antenna structure of claim 3, wherein the first ground point is symmetrically arranged with the second ground point.

5. The antenna structure of claim 3, further comprising a switch circuit, wherein the switch circuit is positioned on the third radiation portion and between the first gap and the second ground point;

wherein the switch circuit is grounded for adjusting a radiation frequency of the third radiation portion.

6. The antenna structure of claim 5, wherein the third feed point is positioned between the switch circuit and the second ground point.

7. The antenna structure of claim 5, wherein the third feed point is positioned between the switch circuit and the first gap.

8. The antenna structure of claim 3, wherein the side frame comprises a first portion, a second portion, and a third portion, the second portion and the third portion are respectively connected to one end of the first portion, each of the second portion and the third portion is longer than the first portion;

wherein the first gap is defined on the first portion, the second gap is defined on the second portion, the third gap is defined on the third portion;

wherein a portion of the side frame which extends from the third gap in a direction away from the first gap and the third radiation portion forms a fourth radiation portion;

wherein the antenna structure further comprises a fourth feed point, the fourth feed point is positioned on the fourth radiation portion and is electrically connected to a fourth feed source for feeding current and signal to the fourth radiation portion, the second ground point and the fourth feed point are positioned at two sides of the third gap.

9. The antenna structure of claim 8, wherein when the third feed point supplies a current, the third radiation portion excites an LTE-A low frequency mode, an LTE-A middle frequency mode, an LTE-A high frequency mode, an ultra-middle frequency mode, an ultra-high frequency mode, and 5G N78/N79 mode;

wherein when the fourth feed point supplies a current, the fourth radiation portion excites an LTE-A middle frequency mode, an LTE-A high frequency mode, an ultra-high frequency mode, and 5G N78/N79 mode.

10. The antenna structure of claim 8, wherein the second feed point is symmetrically arranged with the fourth feed point, the second feed point and the fourth feed point are both grounded through a system ground plane.

11. A electronic device, comprising:

an antenna structure comprising:

a back board defining a slot;

a side frame made of metal material and positioned at a periphery of the back board, wherein the side frame defines at least a first gap and a second gap, the slot is defined at an edge of the back board near the side frame and communicates with the first gap and the second gap; wherein the first gap and the second gap divide a first radiation portion and a second radiation portion from the side frame;

a first feed point positioned on the first radiation portion and being electrically connected to a first feed source for feeding current and signal to the first radiation portion;

a second feed point positioned on the second radiation portion and being electrically connected to a second feed source for feeding current and signal to the second radiation portion; and a first ground point positioned on the first radiation portion and between the first feed point and the second feed point;

wherein when the first feed point and the second feed point supplies current, the first radiation portion and the second radiation generate at least one same radiation frequency band, when current is fed from the first feed point, the first radiation portion excites a GPS mode, a WIFI 2.4 GHz Mode, a WIFI 5 GHz mode and a licensed spectrum auxiliary access (LAA) mode, when current is fed from the second feed point, the second radiation portion excites the WIFI 2.4 GHz mode, the WIFI 5 GHz mode and the LAA mode; and wherein the side frame between the first gap and the second gap forms the first radiation portion, a portion of the side frame which extends from the second gap along a direction away from the first gap and the first radiation portion forms the second radiation portion.

12. The electronic device of claim 11, wherein the side frame at least comprises a first portion and a second portion, the second portion is connected to one end of the first portion, the second portion is longer than the first portion, the first gap is defined on the first portion, the second gap is defined on the second portion;

wherein the first ground point and the second feed point are defined at either side of the second gap, the first feed point is closer to the first gap than the first ground point.

13. The electronic device of claim 11, wherein the side frame defines a third gap, the third gap is symmetrically arranged with the second gap, and is farther away from the first gap than the second gap;

wherein the side frame between the first gap and the third gap forms a third radiation portion, the third radiation portion is longer than the first radiation portion;

wherein the antenna structure further comprises a third feed point and a second ground point, the third feed point is positioned on the third radiation portion and is electrically connected to a third feed source for feeding current and signal to the third radiation portion, the second ground point is positioned on the third radiation portion.

14. The electronic device of claim 13, wherein the first ground point is symmetrically arranged with the second ground point.

15. The electronic device of claim 13, wherein the antenna structure comprises a switch circuit, the switch circuit is positioned on the third radiation portion and between the first gap and the second ground point;

wherein the switch circuit is grounded for adjusting a radiation frequency of the third radiation portion.

16. The electronic device of claim 15, wherein the third feed point is positioned between the switch circuit and the second ground point.

17. The electronic device of claim 15, wherein the third feed point is positioned between the switch circuit and the first gap.

18. The electronic device of claim 13, wherein the side frame comprises a first portion, a second portion, and a third portion, the second portion and the third portion are respectively connected to one end of the first portion, each of the second portion and the third portion is longer than the first portion;

wherein the first gap is defined on the first portion, the second gap is defined on the second portion, the third gap is defined on the third portion;

wherein a portion of the side frame which extends from the third gap in a direction away from the first gap and the third radiation portion forms a fourth radiation portion;

wherein the antenna structure further comprises a fourth feed point, the fourth feed point is positioned on the fourth radiation portion and is electrically connected to a fourth feed source for feeding current and signal to the fourth radiation portion, the second ground point and the fourth feed point are positioned at either side of the third gap.

19. The electronic device of claim 18, wherein when the third feed point supplies a current, the third radiation portion excites an LTE-A low frequency mode, an LTE-A middle frequency mode, an LTE-A high frequency mode, an ultra-middle frequency mode, an ultra-high frequency mode, and 5G N78/N79 mode;

wherein when the fourth feed point supplies a current, the fourth radiation portion excites an LTE-A middle frequency mode, an LTE-A high frequency mode, an ultra-high frequency mode, and 5G N78/N79 mode.

20. The electronic device of claim 18, wherein the second feed point is symmetrically arranged with the fourth feed point, the second feed point and the fourth feed point are both grounded through a system ground plane.

* * * * *